United States Patent [19]

Devienne

[11] 4,404,910

[45] Sep. 20, 1983

[54] MULTICHANNEL CONNECTION AND METHOD FOR TRANSMITTING PYROTECHNIC ORDERS

[75] Inventor: Jules H. P. Devienne, Sartrouville, France

[73] Assignee: Societe Nationale Industrielle Aerospatiale, Paris, France

[21] Appl. No.: 210,816

[22] Filed: Nov. 26, 1980

[30] Foreign Application Priority Data

Dec. 3, 1979 [FR] France ..... 79 29658

[51] Int. Cl.[3] ..... C06C 5/06

[52] U.S. Cl. ..... 102/200; 102/275.4

[58] Field of Search ..... 102/275.11, 275.7, 275.6, 102/275.4, 275.2, 275.1, 275.8, 200

[56] References Cited

U.S. PATENT DOCUMENTS

| | | | |
|---|---|---|---|
| 481,012 | 8/1892 | Doyle | 102/275.1 |
| 530,025 | 11/1894 | Doyle | 102/275.4 |
| 2,418,769 | 4/1947 | Hebard | 102/275.1 |
| 3,170,402 | 2/1965 | Morton et al. | 102/275.8 |
| 3,241,489 | 3/1966 | Andrew et al. | 102/275.8 |
| 3,374,737 | 3/1968 | Pike | 102/275.8 |
| 3,460,477 | 8/1969 | Heidemann et al. | 102/275.2 |
| 3,896,731 | 7/1975 | Kilmer | 102/305 |
| 3,991,679 | 11/1976 | Savitt et al. | 102/275.4 |
| 4,060,033 | 11/1977 | Postupack et al. | 102/318 |

FOREIGN PATENT DOCUMENTS

| | | |
|---|---|---|
| 208875 | 4/1909 | Fed. Rep. of Germany . |
| 263378 | 8/1913 | Fed. Rep. of Germany . |
| 95741 | 4/1971 | France . |

*Primary Examiner*—Charles T. Jordan

*Attorney, Agent, or Firm*—Kerkam, Stowell, Kondracki & Clarke

[57] ABSTRACT

The invention relates to a multichannel connection and to a method for transmitting pyrotechnic orders.

This connection is constituted by a detonating cuttng cord incorporated into a support provided with the same number of openings as there are transmission channels which, on the basis of a single pyrotechnic signal performs a plurality of terminal functions, the connection making it possible to eliminate a certain number of components for distributing and receiving pyrotechnic orders in a logic having a plurality of pyrotechnic chains.

The invention is particularly applicable to the separation and removal of the cover or cone of a ballistic missile.

6 Claims, 5 Drawing Figures

MULTICHANNEL CONNECTION AND METHOD FOR TRANSMITTING PYROTECHNIC ORDERS

BACKGROUND OF THE INVENTION

The present invention relates to a multichannel connection and to a method for transmitting pyrotechnic orders.

The invention relates to the field of pyrotechnics and particularly to a multichannel connection making it possible to distribute and receive pyrotechnic orders by means of a detonating cord, particularly in a logic containing a number of pyrotechnic chains.

At present in a multifunction pyrotechnic chain a plurality of connections are used, which can be of numerous different types depending on the functions which they have to fulfil. They can be in the form of straignt couplings, couplings with two channels, couplings with three channels arranged in the form of a Y or in star-like manner or four-channel couplings. As a result of these couplings the pyrotechnic order can only be multiplied by two or three. In addition they are prejudicial to the reliability of the system due to the number of interfaces involved.

Moreover, in a pyrotechnic logic of the type used in aircraft, missiles and/or rocket launchers numerous pyrotechnic functions are carried out on the basis of several starting signals. The latter are given by means of arming boxes having electrical actuators and detonators. The former consume electrical power often causing a storage problem on board rockets or missiles, whilst the latter contain a primary explosive which is dangerous to use. In addition, the box assembly has a not inconsiderable weight.

BRIEF SUMMARY OF THE INVENTION

The problem of the present invention is to obviate these disadvantages and to in particular make it possible to perform numerous pyrotechnic functions by means of a single starting signal, whilst reducing the number of connections and arming boxes.

It relates to a multichannel connection for transmitting pyrotechnic orders to a number of pyrotechnic chains having multiple functions forming part of a pyrotechnic logic used on board aircraft, missiles and launchers.

This multichannel connection comprises a cutting detonating cord in the form of a dihedron enclosed in a support provided with the same number of openings as there are transmitting channels making it possible to perform a plurality of different terminal functions on the basis of one pyrotechnic signal.

According to another feature of the invention each transmitting channel has a pyrotechnic relay connected to a transmitting sleeve opposite the corresponding opening.

The invention also relates to a method for transmitting pyrotechnic orders making it possible to distribute and receive pyrotechnic orders in a logic having a plurality of pyrotechnic chains fulfilling multiple terminal functions on board aircraft, missiles and launchers. This method is characterized in that such a transmission takes place by using the hollow charge effect of a cutting detonating cord.

According to a variant of the method of the invention the transmission of a pyrotechnic signal to a pyrotechnic chain by means of a cutting detonating cord is effected by an input located at one of the ends of said cord and by an output located at the other end and vice versa.

According to a variant of the method of the invention a pyrotechnic signal is transmitted to a pyrotechnic chain by an input located in an acute angle of the dihedron of the cutting cord and by an output which is also located in said acute angle. The pyrotechnic signal can also be transmitted by an input located on the back of the cord.

When using a cutting cord the hollow charge effect is utilized for transmitting a starting command or signal to a plurality of terminal functions.

By means of such a connection and such a method it is possible to significantly limit the number of pyrotechnic interfaces prejudicial to the reliability of the system.

Moreover, this connection makes it possible to transmit several pyrotechnic orders from a single starting signal, thus limiting the number of arming boxes on a craft such as a missile, aircraft or launcher.

BRIEF DESCRIPTION OF THE DRAWINGS

The invention is described in greater detail hereinafter relative to non-limitative embodiments and with reference to the attached drawings, wherein show:

FIG. 1 is a cross-section through a transmitting channel of a multichannel connection. This multichannel connection is constituted by a cutting cord 1 located in a notch having exactly the same geometrical shape as the cord and which is hollowed into a shaped section 2 in such a way that the dihedron 3 forming the cutting cord has its faces turned towards openings 4 made in cover 5 covering section 2 to which it is closely fixed by any known means. Pyrotechnic relays 6 are located in the openings 4. A pyrotechnic transmitting sleeve 7 is connected to each of the said relays.

FIG. 2 is a larger scale view of the main elements of FIG. 1 making it easier to see the shape of the cutting cord. The relays 6*a* for amplifying the pyrotechnic signal and transmitting the detonation are positioned with respect to the cutting cord 1*a* so that there are pyrotechnic gaps 8 and 9 compatible with the desired effect. FIG. 2 shows the cutting cord in the form of dihedron 3*a*, the back 10*a* of said cord and the pyrotechnic transmitting sleeve 7*a* connected to the corresponding relay 6*a*.

FIG. 3 is a longitudinal sectional view of the multichannel connection of FIG. 1. The openings 20 to 40 made in the multichannel connection constitute twenty transmitting channles of a pyrotechnic starting order via the cutting cord of FIG. 1, whose hollow charge effect is utilized. It is possible to see therefrom the various possibilities of transmitting a pyrotechnic order by means of a cutting cord.

The transmission of a pyrotechnic signal from a cord is reversible, i.e. the signal can arrive by any of the twenty channels, such as channel 20 represented by arrow $F_1$ and can be retransmitted to the nineteen other channels indicated by arrows $F_2$. In the same way the signal can be released at one of the ends of said cord, as indicated by arrow $F_3$, or by the back 10 of said cord as indicated by arrow $F_5$. The cord can then retransmit the pyrotechnic signal either to the other end of the cord indicated by arrow F4 or from the side of the hollow charge, as indicated by arrows $F_2$. However, the cord does not retransmit the signal by cord back 10. When the signal is released by cord back 10, as indicated by arrows $F_5$ and the signal is retransmitted by means of the cord from the side of the hollow charge as indicated by arrows $F_2$, it can be considered that the cord forms a unidirectional multichannel connection.

Obviously the number of transmitting channels is dependent on the number of terminal functions which it is desired to use.

In the case of a twenty channel connection described hereinbefore the transmission of the pyrotechnic signal to the different transmitting channels can be slower or faster as a function of the firing point. If the starting signal is given at one of the ends of the cord, as indicated by arrow $F_3$ or at channel 20, as indicated by arrow $F_1$, the transmission of the pyrotechnic signal will be instantaneous for channels 21, 22, . . . but, although fast, this transmission will be spread over a period of time for the following channels. This makes it possible to regulate the sequence of terminal functions in the desired manner. The same applies regarding firing by the cord back, which can take place at any point of the cord back, as a function of the desired effect.

In the embodiments described hereinbefore the cutting detonating cord is located in a rectilinear shaped section. This configuration is not exlusive and any geometrical shape can be envisaged within the limits of use of the cord.

Figure 1:
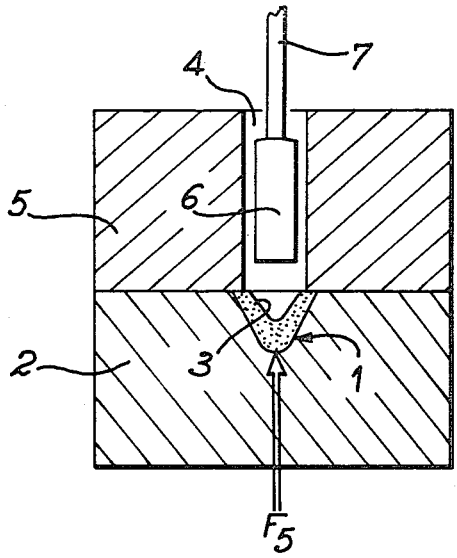
FIG. 1 diagrammatically a cross-sectional view of a multichannel connection according to the invention.
Figure 2:
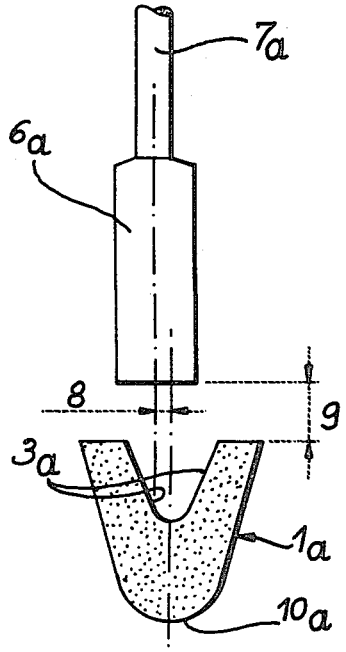
FIG. 2 diagrammatically a larger scale view of the main elements of FIG. 1.
Figure 3:
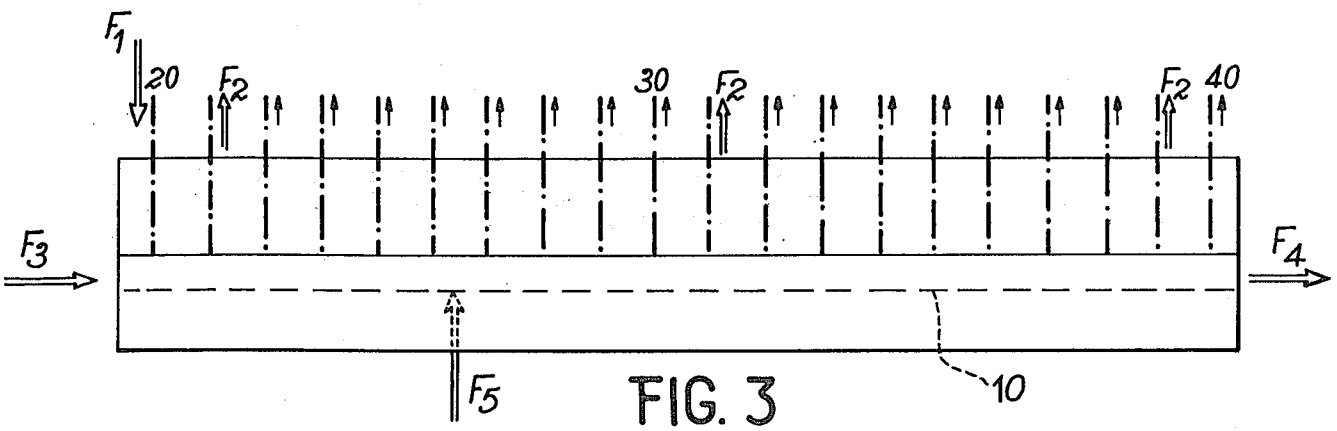
FIG. 3 diagrammatically a longitudinal sectional view of the multichannel connection of FIG. 1.
Figure 4A:
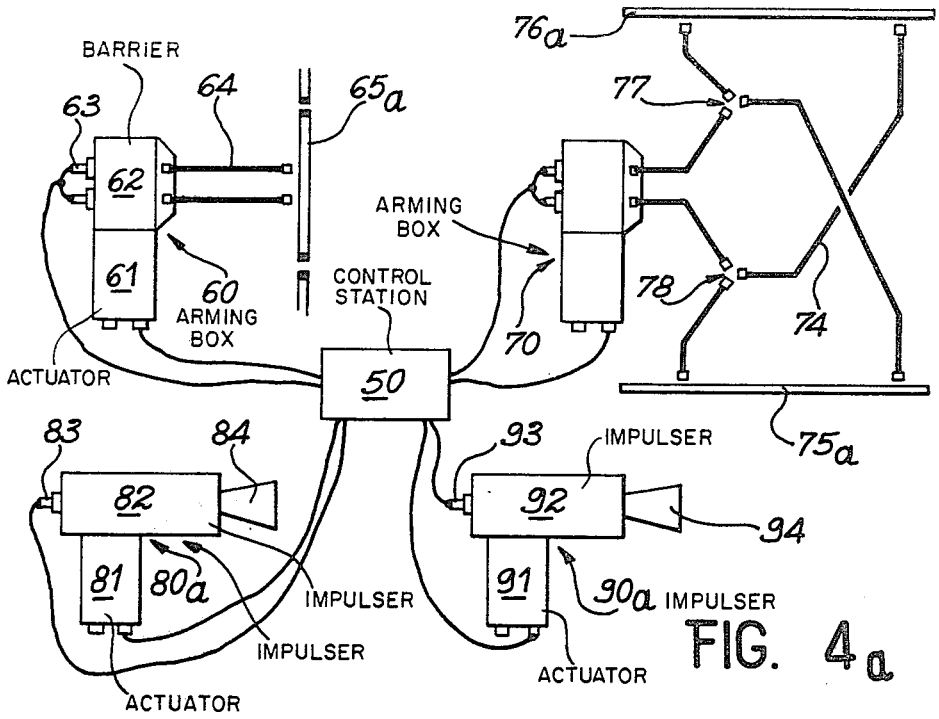
FIG. 4 a diagram of the pyrotechnic order distribution system used for the separation and removal of the cover or cone of a ballistic missile illustrating in a particular case the advantages obtained by using the invention (FIG. 4*b*) compared with the prior art (FIG. 4*a*).

An embodiment of the invention will now be described which, compared with the prior art and with reference to FIG. 4, better illustrates the various advantages provided.

This embodiment relates to the separation and removal of the cover or cone of a ballistic missile. Hitherto for carrying out the various pyrotechnic orders it has been conventional practice to use an electrical control station 50 which firstly controls two arming boxes 60 and 70 in FIG. 4*a*. The first box 60 organizes the circular cut between the equipment container of the final stage of the missile and its cone. The box comprises an electrical locking and/or unlocking actuator 61 and a barrier within box 62 between the detonator 63 and a pyrotechnic chain 64. The latter has two channels, namely a normal channel and an emergency channel leading to a cutting cord 65*a*. The detonators are charged with a primary explosive.

The second box 70 having the same components as the first arming box, controls the longitudinal cutting of the cone from its base to the tip in order to form two half-shells via a pyrotechnic chain 74 equipped with two three-channel connections 77, 78 and leading to two cutting cords 75*a*, 76*a*.

Moreover, the electrical control centre controls two impulsers 80*a* and 90*a* making it possible to remove the two half-shells. An impulser is fixed to each half-shell and is removed with the latter. These impulsers are constituted by an electrical locking and/or unlocking actuator 81 or 91 and a barrier positioned within impulser 82 or 92 between an igniting or firing means 83 or 93 and an impulsing nozzle 84 or 94.

Thus, at present the cutting of a ballistic missile cone, followed shortly thereafter by its removal, requires the use of two arming boxes, four electrical actuators, four detonators and two igniting or firing means, accompanied by at least two three-channel connections.

By using the pyrotechnic order transmitting method according to the invention it is possible in the present case to eliminate one arming box, three electrical actuators, two detonators, two igniting or firing means and the three-channel connections.

A significant improvement to the electrical balance results from the elimination of the three electrical actuators. Finally the provision within a missile of a certain quantity of electrical power is linked with the number of stored batteries. The more electrical power that is required, the more batteries are needed to provide it. Thus, the reduction of the number of actuators leads to the availability of a larger quantity of electrical power and as a corollary makes available more space and a reduction in weight, which is aided by the elimination of one arming box.

Moreover, the method according to the invention makes it possible to eliminate the detonators of one arming box, as well as the impulser firing means. This increases the safety of the system, because these elements are generally charged with a primary explosive which is dangerous to use making it necessary to provide a barrier between the latter and the pyrotechnic chain.

Finally, the elimination of the three-channel connections significantly reduces the number of pyrotechnic interfaces which are prejudicial to the reliability of the system.

Figure 4B:
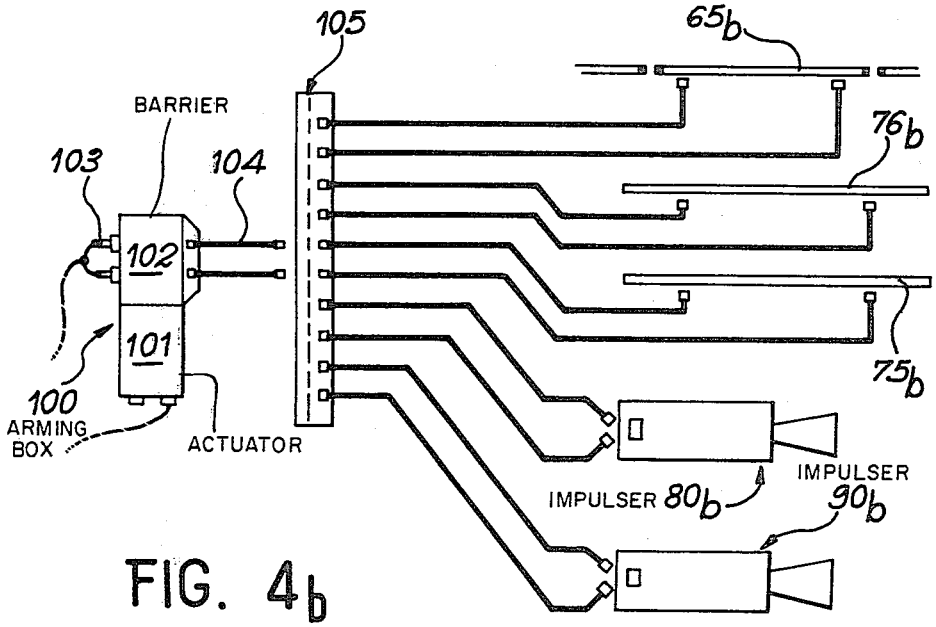

In the solution using the method of the invention diagrammatically shown in FIG. 4*b* a single arming box 100 having an electrical actuator 101 and a barrier within box 102 between detonators 103 and a pyrotechnic chain 104 ensures the firing of a detonating cutting cord forming a multichannel connection 105. The other components referred to remain unchanged.

What is claimed is:

1. A multichannel connection making it possible to transmit pyrotechnic orders to a plurality of pyrotechnic chains having multiple functions forming part of a pyrotechnic logic used on board aircraft, missiles and launchers, wherein it is constituted by a detonating cutting cord in the form of a dihedron incorporated into a support provided with the same number of openings as there are transmitting channels which, on the basis of one pyrotechnic signal performs a plurality of different terminal functions.

2. A connection according to claim 1, wherein each transmitting channel has a pyrotechnic relay connected to a transmitting sleeve facing each opening.

3. A method for transmitting pyrotechnic orders making it possible to distribute and receive pyrotechnic orders in a logic having a plurality of pyrotechnic chains for performing multiple terminal functions on board aircraft, missiles and launchers, wherein this transmission is performed by using the hollow charge effect of a detonating cutting cord in the form of a dihedron having an acute angle.

4. A method according to claim 3, wherein the transmission of a pyrotechnic signal to a pyrotechnic chain by means of a detonating cutting cord is effected by an input located at one of the ends of said cord and by an output located at the other end and vice versa.

5. A method according to claim 3, wherein the transmission of a pyrotechnic signal to a pyrotechnic chain by means of a detonating cutting cord is effected by an input located on the back of the cord.

6. A method for transmitting pyrotechnic orders making it possible to distribute and receive pyrotechnic orders in a logic having a plurality of pyrotechnic chains for performing multiple terminal functions on board aircraft, missiles and launchers, wherein this transmission is performed by using the hollow charge effect of a detonating cutting cord in the form of a dihedron having an acute angle, wherein the transmission of a pyrotechnic signal to a pyrotechnic chain is effected by means of an input located in the acute angle of the dihedron of the cord and by an output also located in said acute angle.

* * * * *